US011078602B2

(12) United States Patent
Pede-Vogler et al.

(10) Patent No.: US 11,078,602 B2
(45) Date of Patent: Aug. 3, 2021

(54) YARN HEAD ROTOR

(71) Applicant: Saurer Germany GmbH & Co. KG, Remscheid (DE)

(72) Inventors: Walter Pede-Vogler, Durach (DE); Andrej Raisich, Kempten (DE); Otto Scheitll, Kempten (DE)

(73) Assignee: Samer Technologies GmbH & Co. KG, Krefeld (DE)

( * ) Notice: Subject to any disclaimer, the term of this patent is extended or adjusted under 35 U.S.C. 154(b) by 0 days.

(21) Appl. No.: 15/484,586

(22) Filed: Apr. 11, 2017

(65) Prior Publication Data

US 2017/0350041 A1 Dec. 7, 2017

(30) Foreign Application Priority Data

Jun. 2, 2016 (DE) ..... 10 2016 006 832.9

(51) Int. Cl.

| | |
|---|---|
| ***D01H 1/10*** | (2006.01) |
| ***D02G 3/28*** | (2006.01) |
| ***D01H 7/86*** | (2006.01) |

(52) U.S. Cl.

CPC ..... *D01H 1/103* (2013.01); *D01H 1/10* (2013.01); *D01H 7/86* (2013.01); *D01H 7/868* (2013.01); *D02G 3/285* (2013.01)

(58) Field of Classification Search

CPC ..... D01H 1/101; D01H 7/86; D01H 7/868; D01H 1/103; D01H 1/10; D02G 3/285

(Continued)

(56) References Cited

U.S. PATENT DOCUMENTS 2,549,821 A * 4/1951 Klein ..... D01H 1/10 57/58.76
2,703,261 A * 3/1955 Beck ..... D01H 1/241 384/512

(Continued)

FOREIGN PATENT DOCUMENTS

DE 4309474 C1 * 5/1994 ..... D01H 15/007
DE 19700222 C1 10/1997

(Continued)

OTHER PUBLICATIONS

Schlagenhaft Walter, FR2751667-A1, Jan. 1998, English translation of description via espacenet.com, acquired on Jan. 10, 2019. (Year: 1998).*

(Continued)

*Primary Examiner* — Shaun R Hurley
*Assistant Examiner* — Patrick J. Lynch
(74) *Attorney, Agent, or Firm* — Nelson Mullins Riley & Scarborough LLP

(57) ABSTRACT

A yarn head rotor 1 for a cabling machine, having several deflection rollers 2 for evening the yarn tension of two yams being twisted, each deflection roller being rotatably mounted on a pivot axis 5 at right angles to the rotor axis of the yarn head rotor 1 and guided across the two yarns. The deflection roller 2 is mounted in the yarn head rotor 1 by bearings 6 at both ends of the deflection roller 2, wherein the two ball bearings 6 are each enclosed by a housing 7 of the yarn head rotor 1, which is closed with a cover 8, and yarn guiding eyelets 9, guiding the inner and outer yarns 17, are arranged upstream of the deflection roller 2 in such a way that they supply both yarns of the deflection roller between the two ball bearings 6 to the yarn head rotor 1.

9 Claims, 6 Drawing Sheets

(58) Field of Classification Search
USPC ..... 57/58.54
See application file for complete search history.

(56) References Cited

U.S. PATENT DOCUMENTS 3,080,199 A * 3/1963 Rickley ..... B21B 31/074 384/584
3,141,286 A * 7/1964 Takita ..... D01H 7/18 57/73
3,232,684 A * 2/1966 Neubert ..... D01H 7/048 384/271
6,070,325 A * 6/2000 Miyata ..... F16C 19/186 29/898.09
6,161,962 A * 12/2000 French ..... B61F 15/20 384/448
2001/0037685 A1* 11/2001 Bode ..... B21B 31/07 73/593
2014/0237983 A1* 8/2014 Love ..... D02G 3/48 57/238

FOREIGN PATENT DOCUMENTS

DE 202014001571 * 5/2015 ..... D01H 1/10
EP 1371761 A2 12/2003
EP 1895033 A2 3/2008
FR 2751667 A1 * 1/1998 ..... D01H 1/10

OTHER PUBLICATIONS

Weber Rolf-Deiter, DE4309474-C1, May 1994, English translation of description via espacenet.com, acquired on Jan. 9, 2019. (Year: 1994).*
English translation of DE202014001571 to Felber, from espacenet.com (last visited Sep. 6, 2019).*

* cited by examiner

YARN HEAD ROTOR

CROSS-REFERENCE TO RELATED APPLICATIONS

This application claims priority from German National Patent Application No. DE 10 2016 006 832.9, filed Jun. 2, 2016, entitled "Zwirnkopfrotor", the entire contents of which are incorporated herein by reference.

FIELD OF THE INVENTION

The invention concerns a yarn head rotor for a cabling machine, and more particularly concerns a yarn head rotor comprising several deflection rollers for evening out the yarn tension of two yarns to be twisted, which are each rotatably mounted on a pivot axis arranged at right angles to the rotor axis of the yarn head rotor in said yarn head rotor and over which the two yarns are guided.

BACKGROUND OF THE INVENTION

Cabling is a mechanical yarn finishing method for producing certain usage characteristics in the yarn. Cabling is a particular twisting method where two yarns are twisted with each other without the individual yarns themselves being turned. The advantage of so-called cord yarns produced by cabling lies in their higher tensile strength, as individual filaments always lie precisely in the load direction. Cabling is preferably carried out mainly during tyre cord manufacture.

A first feed package is arranged on a rotating spindle in a bobbin bucket during the operation of a cabling spindle. The bobbin bucket and feed package themselves are however secured against rotation. A so-called inner yarn is pulled off axially upwards from this feed package and guided through an inner yarn brake with the outer yarn on its way to the cabling or joining point.

A second feed package, from which the outer yarn is pulled, is arranged in a creel. Once the outer yarn has passed an outer yarn brake and possibly a deflection means it runs into the spindle rotor axially from below. The outer yarn is also guided to the joining point with the inner yarn from the spindle rotor whilst forming a yarn balloon, where the outer yarn is finally wound around the inner yarn.

To ensure that both the inner as well as the outer yarn can be cabled with the same yarn tension and an evenly twisted yarn is created both yarns run through a regulating or tension balancing device, also known as a cord regulator. Different yarn tensions in individual yarns will show up in the subsequent twisted yarn or cord as different individual threat lengths and lead to a reduction in the maximum traction and fatigue strength.

Such overlengths are avoided with the aid of the cord regulator and both yarns are guided towards the joining point with the most similar yarn tension possible. This applies not only for the operational compatibility of the cabling spindle, but also during the start and stop phase.

A yarn head with a rotor for a cabling machine is disclosed in German Patent Publication DE 197 00 222 C1. This yarn head rotor comprises four balancing rollers, of which two each are arranged on one side of an symmetrical plane extending through the rotor axis and the two other rollers symmetrically to the first on the other side of the symmetrical plane. Two rollers lying opposite each other in relation to the symmetrical plane are paired in a torque-proof way and arranged at both ends of the common shaft spigot, the pivot axis of which extends vertical to the symmetrical plane and at a radial distance from the axis of rotation of the rotor, and the middle of which is rotatably mounted on the rotor by means of a ball bearing.

A disadvantage of such a yarn head rotor is that substantial centrifugal forces act on the ball bearings because of the distance of the ball bearings from the rotor axis and due to the high spindle speeds. Centrifugal forces throw all but a small residue of the grease filling out of the ball bearings. This grease residue is used up during further operation until the ball bearings run dry. This degreasing due to centrifugal forces cannot be prevented even with ball bearings sealed according to the latest technology. The ball bearings will therefore have only a very short working life and must be greased or replaced regularly, resulting in great effort.

In order to solve this problem and achieve a longer working life for these bearings a roller arrangement for a yarn head rotor is described in European Patent Publication EP 1 371 761 A2 the bearings of which can be greased in a simple way. For this the roller pairs are each mounted in a roller cartridge with a housing and the roller cartridges are replaceably fixed to the yarn head rotor by means of disconnectable fittings. The roller cartridges can be easily removed from the yarn head rotor for greasing, are then greased with a greasing device, and are re-inserted into the take-up on the yarn head rotor envisaged for this.

One disadvantage of this approach is that the effort for greasing the bearings is substantial despite the roller cartridge. Removal and installation always result in undesired downtime of the cabling machine.

To remove this disadvantage and enable a greasing of the bearings without additional assembly effort European Patent Publication EP 1 895 033 A2 discloses a yarn head rotor on which one of the two bearing bores is connected with a connection means for supplying a grease, and the two bearing bores are connected with each other via a through bore. The roller bearings are here sealed on their side facing the balancing rollers by means of internal roller bearing sealing discs. In this way both bearings can be greased during one working step without removal and installation of said bearings. Greasing in their installed position means that the maintenance interval required for this greasing is shortened and frequent greasing is possible without reducing overall productivity.

One disadvantage of a yarn head rotor according to European Patent Publication EP 1 895 033 A2 is that an incorrect greasing using too much grease or under excessive pressure may press the sealing discs out of the roller bearings and they will then no longer be able to carry out their sealing function. If the yarn head rotor is then operated without adequate sealing this will lead to an extremely fast grease loss and a total failure of the corresponding roller bearing.

SUMMARY OF THE INVENTION

Based on this prior art mentioned above, it is the task of the invention to develop a yarn head rotor designed in such a way that the grease loss of the bearings due to centrifugal forces occurring is at least reduced.

Briefly summarized, the present invention addresses the intended task in a yarn head rotor for a cabling machine which comprises several deflection rollers for evening out the yarn tension of two yarns to be twisted, which are each rotatably mounted on a pivot axis arranged at right angles to the rotor axis of the yarn head rotor and over which the two yarns are guided. According to the present invention, at least one deflection roller is mounted in the yarn head rotor by bearings at both ends of the at least one deflection roller, the two bearings are each enclosed by a housing of the yarn head rotor, which is closed with a cover, and yarn guiding eyelets, guiding the inner and outer yarns, are arranged upstream of the at least one deflection roller in such a way that they supply both yarns to the at least one deflection roller between the two bearings of the yarn head rotor.

The construction of a yarn head rotor with a double-sided mounting of the at least one deflection roller in the molded body according to the invention results in that the bearings can be sealed against grease loss. The description "bearing" is used as a synonym for roller bearings, ball bearings or glide bearings installed in the yarn head rotor as part of this invention.

With the previous cantilever mounting, where the bearings were arranged on the inside and the deflection rollers on the outside, the centrifugal force generated during the operation of the cabling machine threw all but a residual amount of the grease filling out of the ball bearings. With the now outer arrangement of the bearings and inner arrangement of the deflection rollers as well as the design of a housing around said bearings, the grease no longer collects on the machine wall after exiting from the bearings as with the known embodiments, but remains in the housing. Centrifugal force still occurs and throws the grease towards the outside, which then bounces off the inside of the cover and collects in a gap between the ball or glide bearings of the deflection rollers and the cover or a lid, which seals the bearing point. If this gap is designed as small as possible, grease will remain near the bearing point.

Grease loss from the deflection rollers in the yarn head rotor can therefore be reduced substantially, if not prevented altogether. Frequent maintenance intervals for greasing or replacing the bearings can be omitted or are reduced to a minimum. The working life of the bearings of the yarn head rotor is also increased considerably, as they can now be operated in an adequately greased condition at all times.

A further advantage that has a positive effect on the working life of the bearings is that the double-sided mounting makes the bearing loads more moderate than is the case with a cantilever mounting.

It is feasible as part of the invention that either roller bearings or glide bearings are used. Both bearing types can be designed in such a way here that either the inner ring or the outer ring is rotatably mounted.

It is a further important advantage of the invention that a construction dependent unthreading protection is realised for individual yarns. The cantilever mounting of the deflection rollers previously allowed individual yarns to slide off the deflection rollers during the start and stop phase or when the spindle stood still, so that renewed manual threading was necessary before the production process could be continued. In the worst case an unthreading of individual yarns would lead to the formation of knots, which then had to be removed manually with even greater time effort.

This unthreading protection therefore not only reduced the manual effort, but also minimises faults occurring in the twisted yarn caused by a faulty threading.

According to a feature of the invention, the cover advantageously represents a grease seal for the respective housing of the yarn head rotor.

Such a design can reduce the grease loss further. The cover, which is necessary for closing the housing in which the bearing is arranged, here corresponds with a grease seal and a lid, which seals the bearing point itself. The grease seal can for example be formed by an O-ring or a rubber disc.

According to another aspect of the invention, exactly two deflection rollers are arranged in the yarn head rotor, and the two pivot axes of the deflection rollers are arranged on a plane that is transverse or parallel to the rotor axis.

It is of advantage with such a design of a yarn head rotor that the inner as well as the outer yarn are guided across both deflection rollers once in different wrapping directions, which reduces the occurrence of different individual yarn lengths resulting from production dependent, uneven diameters of the deflection rollers.

The pivot axes of the two deflection rollers lie on one plane but can be arranged differently here. A parallel arrangement of the plane of the pivot axes in relation to the rotor axis as feasible as a transverse or diagonal arrangement, wherein the diagonal arrangement can have any angle from the parallel arrangement to, and including, a vertical alignment of the plane of the pivot axis of the deflection rollers to the rotor axis.

The load that acts on the bearings of the two deflection rollers is distributed more evenly with a vertical alignment of the plane of the pivot axis of the deflection rollers to the rotor axis in particular. The symmetrical arrangement of the deflection rollers in the yarn head rotor also acts positively in that the yarn head rotor is easier to balance.

In a preferred embodiment, the yarn guiding eyelets are aligned in such a way that they guide both yarns to different deflection rollers, so that different embracing directions result.

Such an alignment and arrangement of the yarn guiding eyelets also contributes towards an unthreading protection for individual yarns during the critical phases with the yarn rotor according to the invention. This construction dependent unthreading protection improved the quality of the twisted yarn to be produced, as the possibilities of incorrect threading, for example after a spindle stop, are reduced.

According to a further feature, the cover of each housing can be used for positioning the respective bearing with the deflection roller.

The cover advantageously defines the working position of the bearing point and guarantees a precise alignment of the deflection roller.

For logical reasons the cover is disconnectably mounted on the housing and can also be removed from the housing or taken off the same for maintenance purposes. A replacement of the deflection rollers including bearings can therefore be realised in a simple and uncomplicated way.

According to another aspect of the invention, a common housing each is provided in particular for the neighboring bearings of the deflection rollers.

For production engineering reasons it is particularly favourable if the two neighboring bearings of the deflection rollers can be arranged in one housing. In this way only one cover per housing is required.

It is of course also feasible as part of the invention that each bearing is enclosed by a separate housing, which each have a cover. The single-part design of the housing does however simplify the production and assembly process.

BRIEF DESCRIPTION OF THE DRAWINGS

The invention will now be described in more detail with reference to the embodiment examples illustrated in the drawings, wherein.

DETAILED DESCRIPTION OF THE INVENTION

Figure 1:
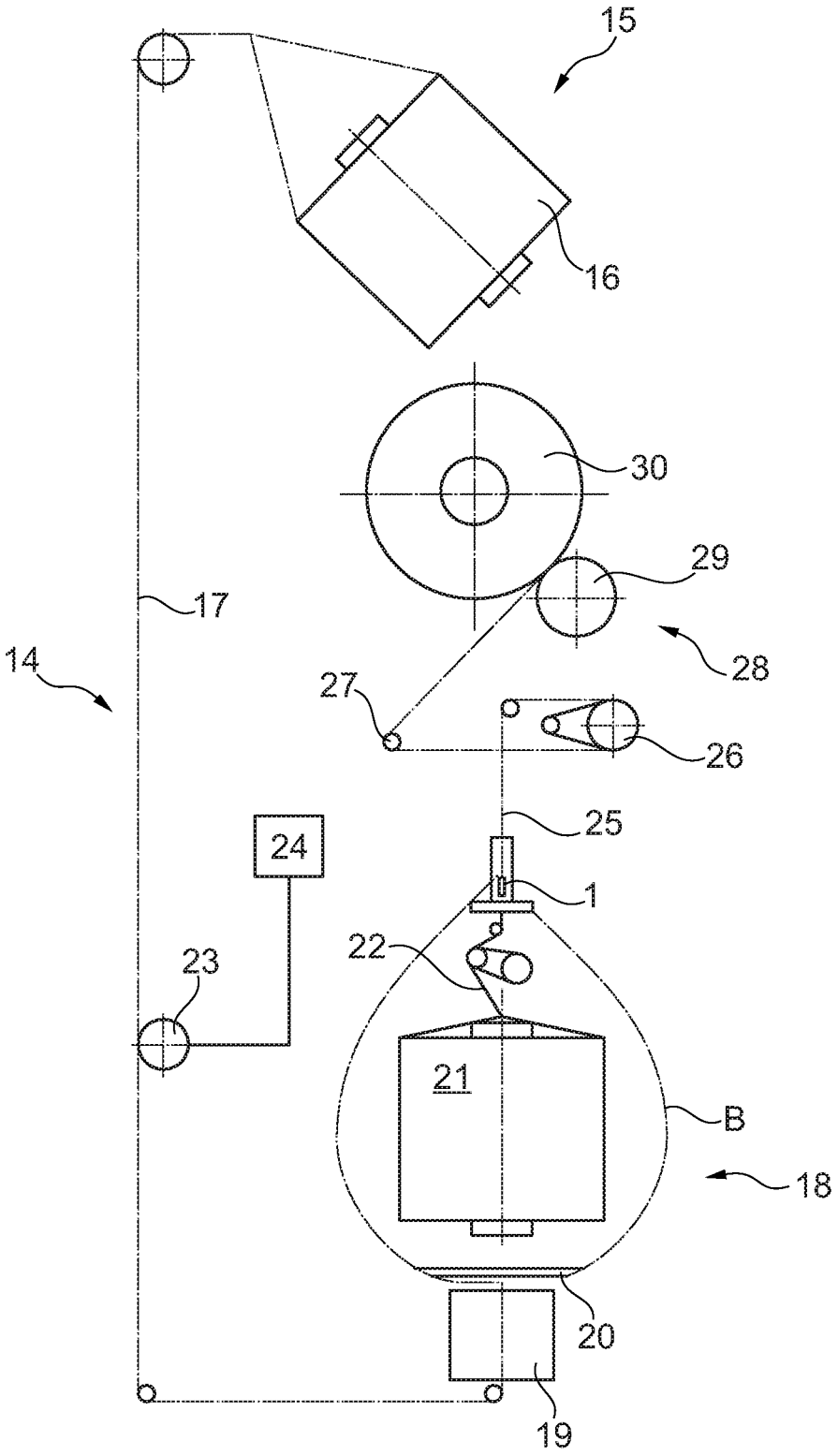
FIG. 1 is a schematic view of a workstation of a cabling machine.

The construction of a workstation 14 of a cabling machine is illustrated in a schematic view in FIG. 1. The workstation 14 comprises a creel 15, which serves for receiving at least one second feed package 16, from which a so-called outer yarn 17 is pulled.

The workstation 14 further comprises a cabling spindle 18, driven by a spindle drive 19. The spindle drive 19 can be a motor that drives the cabling spindle 18 directly, or an indirect drive, for example a belt drive. The cabling spindle 18 bears a first feed package 21 on a yarn plate 20 arranged on the cabling spindle 18, from which a so-called inner yarn 22 is pulled overhead, which is supplied to a yarn head rotor 1 above the cabling spindle 18.

The outer yarn 17 pulled from the second feed package 16 is supplied to a regulatable yarn tension influencing device 23 arranged between the creel 15 and the cabling spindle 18 in the yarn run, with which the yarn tension is varied. For this the yarn tension influencing device 23 is connected with a controller 24, which regulates the yarn tension generated by the device 23. The yarn tension influencing device 23 is located upstream from the yarn plate 20 viewed in the yarn pulling direction. The outer yarn 17 then runs through the spindle drive 19 in the pivot axis and leaves the spindle drive 19 below the yarn plate 20. The outer yarn 17 is deflected tangentially to the yarn plate 20 by means of a deflector and runs up to the outermost edge of the yarn plate 20. The outer yarn 17 is deflected upwards at the edge of the yarn plate 20, so that the outer yarn 17 runs around the first feed package 21 along the cabling spindle 18 whilst forming a free yarn balloon B. The yarn head rotor 1 determines the height of the developing free yarn balloon B in that the outer yarn 17 pulled from the second feed package 16 and the inner yarn 22 pulled from the first feed package 21 are joined. The cabling, or also joining point, where the two yarns 22, 17 are joined and form the twisted yarn 25, is located in the yarn head rotor 1.

An extraction device 26 is arranged above the cabling point, with which the yarn 25 is pulled off and supplied to a winding device 28 via a balancing element 27. The winding device 28 comprises a drive roller 29 and a bobbin 30 driven by the drive roller 29 by means of friction.

Figure 2:
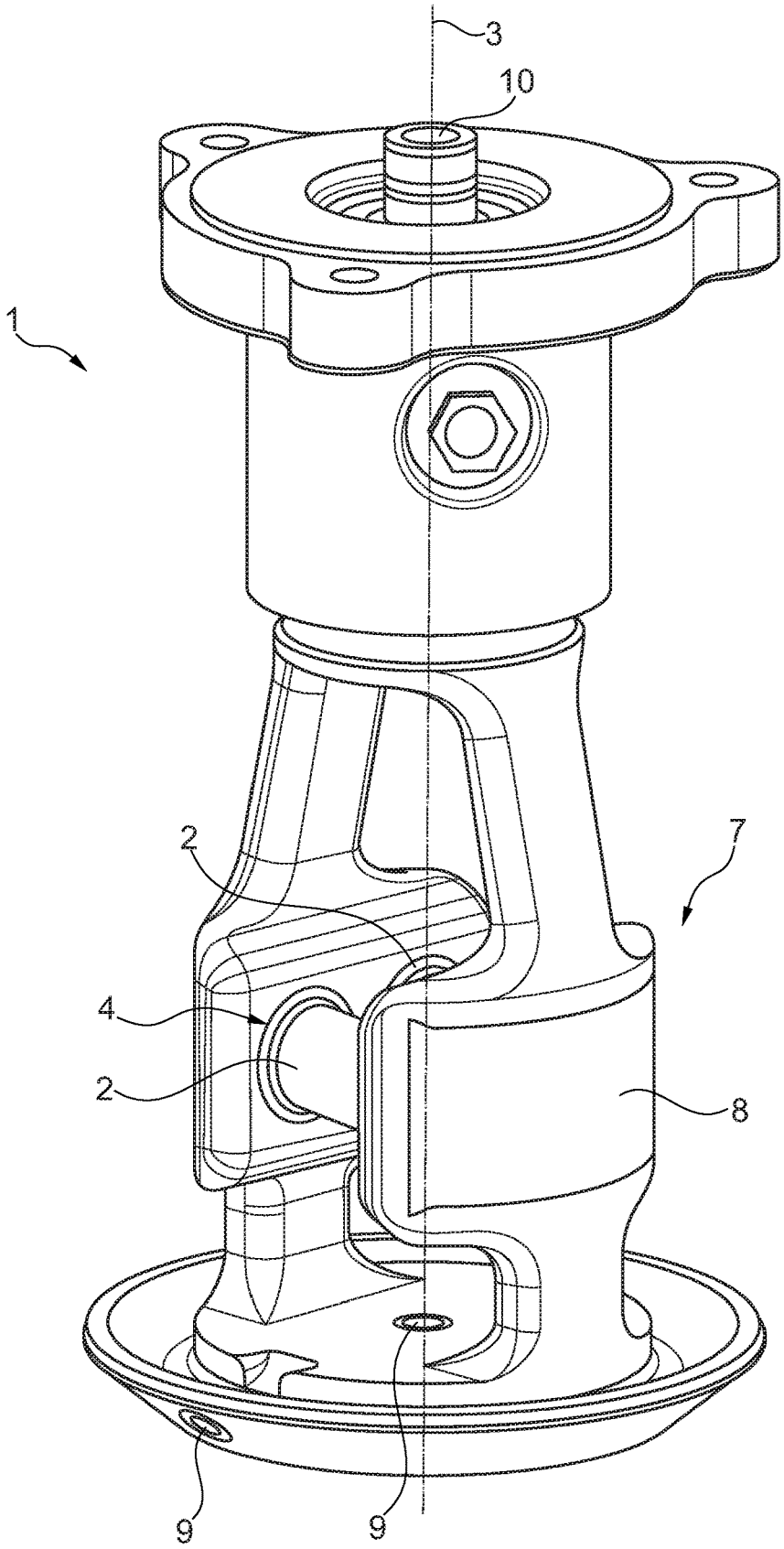
FIG. 2 schematically depicts an enlarged view of a cord regulator according to the invention with two deflection rollers.

FIG. 2 shows a yarn head rotor 1 for a cabling machine, comprising two deflection rollers 2. The yarn head rotor 1 is equipped with four bearing bores 4 arranged vertically to the axis of rotation 3 of the yarn head rotor 1. Two opposing bearing bores 4 each serve for receiving one pivot axis 5, mounted in the respective bearing bores 4 by means of two ball bearings 6. The pivot axes 5 are each designed as a deflection roller 2. This means that the deflection rollers 2 are each mounted in a housing 7 of the yarn head rotor 1 on both sides, which is closed by a cover 8.

A guiding eyelet 9 each for guiding the inner 22 and outer yarn 17 is envisaged below the deflection roller 2 at the lower end of the yarn head rotor 1. The inner 22 and outer yarn 17 enter the yarn head rotor 1 through these guiding eyelets 9.

The inner yarn 22 pulled from the first feed package 21 arranged in the bobbin bucket runs through the guiding eyelet 9 arranged in the central area of the threat head rotor 1 into the yarn head rotor 1 and embraces a deflection roller 2. From there the inner yarn is routed downward and S-shaped to embrace the other deflection roller 2. The inner yarn 22 is then supplied from this deflection roller 2 in the direction of an upper guiding eyelet 10 to the joining point, where both are twisted into individual twisting yarns.

The outer yarn 17 pulled from a second feed package arranged in the creel 15 rotates as a yarn balloon B around the bobbin bucket and enters the yarn head rotor 1 through the guiding eyelet 9 arranged in the edge area of the yarn rotor 1. The outer yarn 17 embraces the deflection rollers 2 in an S shape, but in the opposite order as the inner yarn 22, in the same way as described above with regard to inner yarn 22 in order to then also be supplied to the joining point in the direction of the upper eyelet eye 10.

The individual yarns twisted together with each other leave the yarn head rotor 1 as a twisted yarn 25 or cord and are then wound up.

Figure 3:
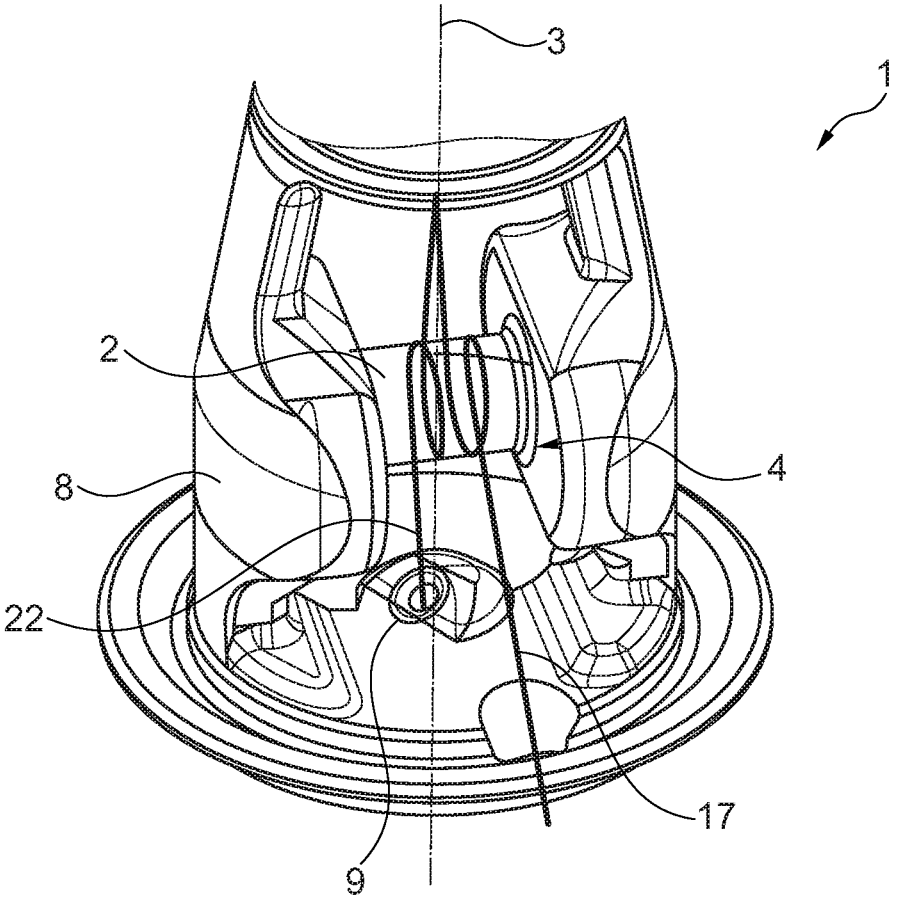
FIG. 3 schematically depicts an enlarged view of an alternative cord regulator with a deflection roller.

FIG. 3 shows an alternative embodiment of the yarn head rotor 1. The only difference from FIG. 2 already described is that the yarn head rotor 1 comprises just one deflection roller 2 in this example, which is embraced by the inner yarn 22 as well as the outer yarn 17. The single deflection roller 2 is also mounted on both sides. As the function of both yarn head rotors 1 is otherwise identical we omit repetition at this point refer to the description of FIG. 2.

Figure 4:
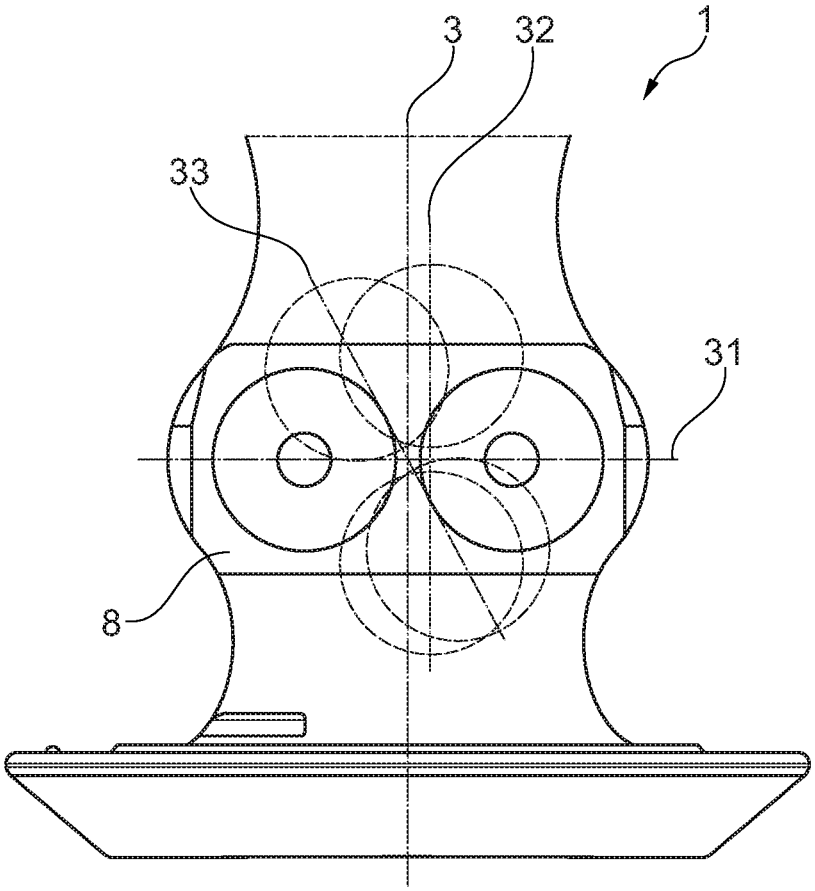
FIG. 4 schematically depicts various arrangements of the pivot axis of the deflection rollers.

FIG. 4 schematically shows a different arrangement of the deflection roller 2, wherein the pivot axes 5 of the deflection rollers 2 lie on one plane. Reference number 31 identifies a vertical arrangement of the pivot axes 5 of the deflection rollers 2 in relation to the axis of rotation 3 of the yarn head rotor 1. Reference number 32 indicates the formation of an alignment of the pivot axes 5 that is parallel to the axis of rotation 3. A plane of the pivot axis 5 arranged at a defined angle to the axis of rotation 3 is identified with reference number 33. The angle can be selected anywhere between the vertical or parallel arrangement of the pivot axes 5 in relation to the axis of rotation 3 here.

Figure 5:
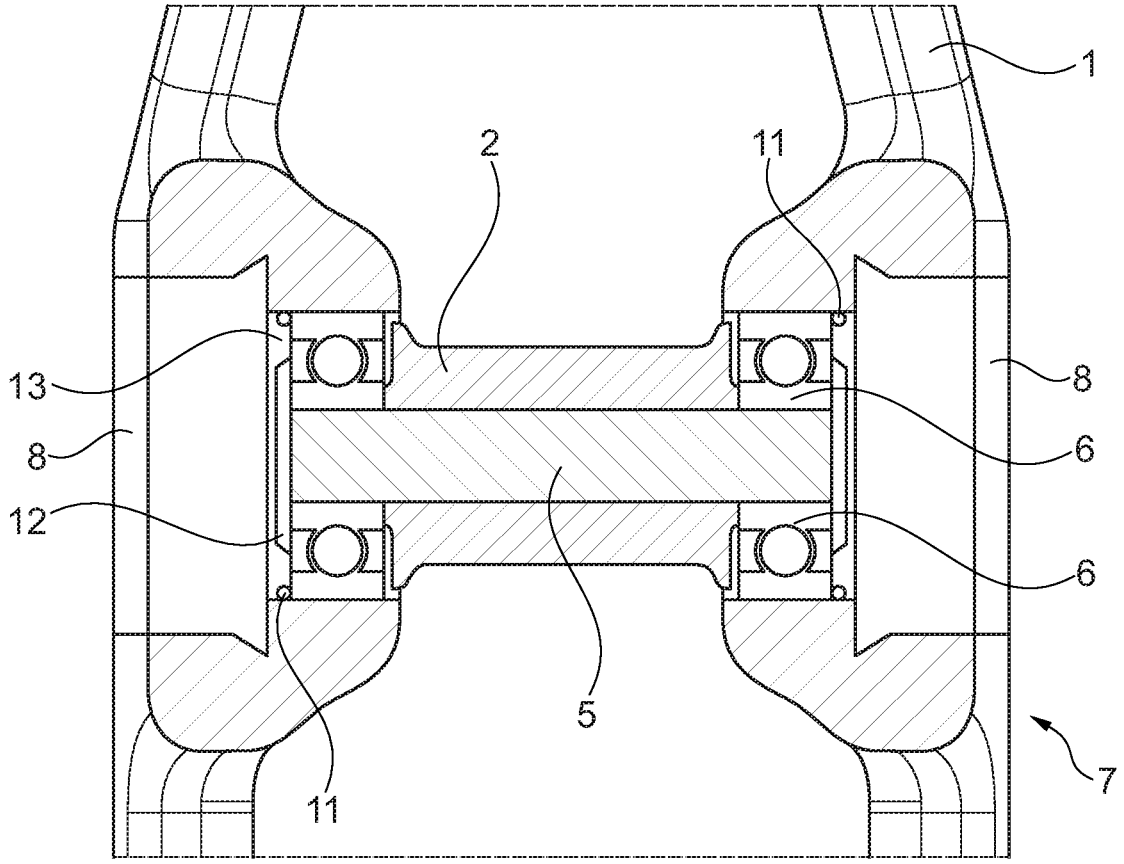
FIG. 5 schematically depicts the double-sided mounting of a deflection roller with a rotating inner ring.

FIG. 5 schematically shows the double-sided mounting of an example of a deflection roller 2. A ball bearing 6 is envisaged at both ends of the pivot axis 5 for the rotatable mounting of the inner ring of the deflection roller 2.

Grease is thrown towards the outside during operation due to centrifugal force generated by the rotation of the yarn head rotor 1. The housing 7 of the yarn head rotor 1 is closed with a cover 8 on the outside. The cover 8 defines the working position of the bearing point of the ball bearing 6, secures the bearing point against centrifugal force generated, and also supports the sealing of the bearing point of the ball bearing 6.

Reference number 11 identifies a grease seal, in this case an O-ring. The bearing point of the ball bearing 6 is sealed together with the lid 13. The gap 12 is located in the lid 13, so that grease accumulated there will for example be in viscosity connection with the grease in the bearing point when the yarn head 1 stands still, and will therefore grease the function points. The grease thus remains near the ball bearing 6 or the rolling elements.

Figure 6:
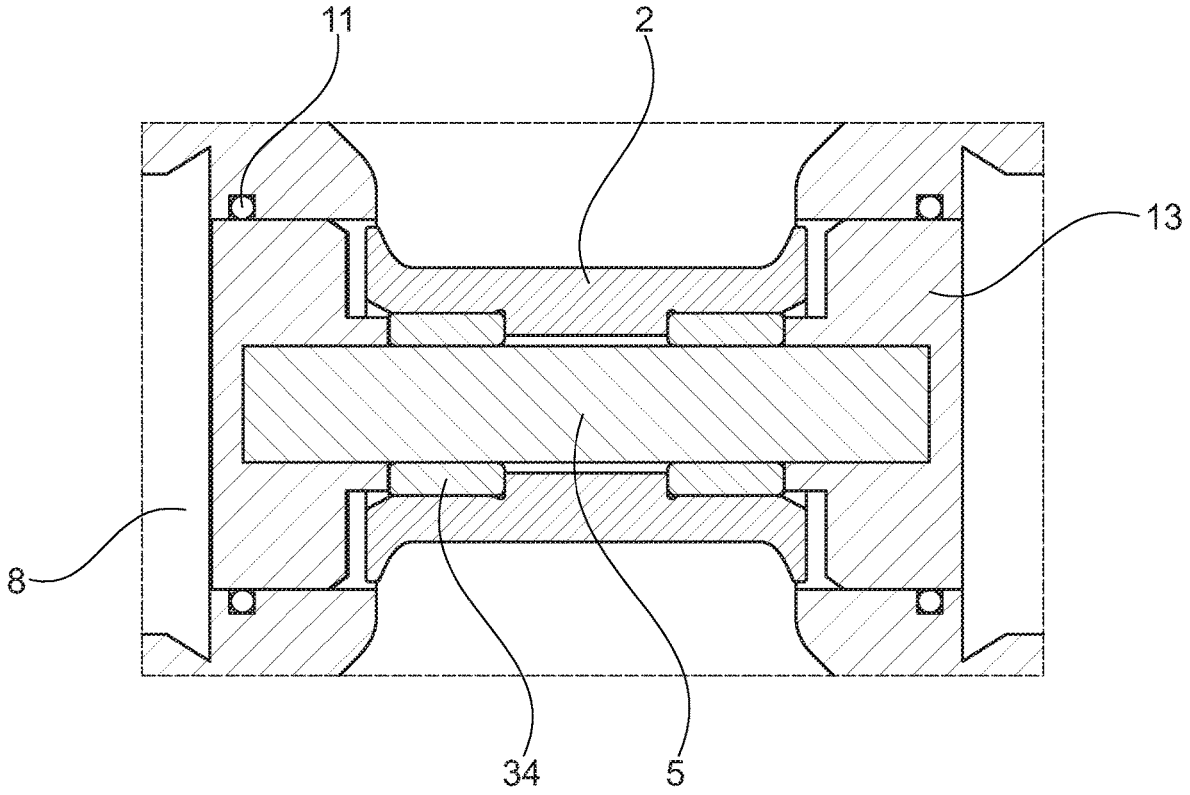
FIG. 6 schematically depicts the double-sided mounting of a deflection roller with a rotating outer ring.

FIG. 6 shows an embodiment example of a glide bearing 34 with a rotating outer ring. The mounting of the deflection roller 2 forms a mounting unit with the pivot axis 5. As already described for FIG. 5, grease is thrown towards the outside during operation due to the centrifugal force generation by the rotation of the yarn head rotor 1. The lid 13 installed between the housing 7 of the yarn head rotor 1 and the deflection roller 2 prevents the fat from leaving the bearing point. Grease collected on the lid 13 flows back into the bearing point via the viscosity connection when the process is interrupted and the glide bearing 34 stand still, and thus greases these automatically. The installed grease seal 11 seals the lid 13 against a direct escape of grease. Alternatively the grease seal 11 can also be integrated into the lid 13 in that the grease seal 11 is made from a deformable material, such as for example rubber.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Yarn head rotor for a cabling machine, comprising several deflection rollers for evening out the yarn tension of two yarns to be twisted, each of the deflection rollers being rotatably mounted on a pivot axis arranged at right angles to a rotor axis of the yarn head rotor and over which the two yarns are guided, characterized in that, at least one deflection roller is mounted in the yarn head rotor by bearings at both ends of the at least one deflection roller, that two of the bearings are each enclosed by a housing of the yarn head rotor wherein the housing is closed with a cover and a gap sealed with a lid is located between the bearings of the at least one deflection roller and the cover, and that yarn guiding eyelets, guiding inner and outer yarns, are arranged upstream of the at least one deflection roller in such a way that inner and outer yarns are supplied to the at least one deflection roller between the two bearings of the yarn head rotor, wherein the lid and the cover are two separate components.

2. Yarn head rotor according to claim 1, characterized in that the cover corresponds with a grease seal for the housing of the yarn head rotor.

3. Yarn head rotor according to claim 1, characterized in that precisely two deflection rollers having pivot axes are arranged in the yarn head rotor and that both pivot axes of the deflection rollers are arranged on a plane formed transverse or parallel to the rotor axis.

4. Yarn head rotor according to claim 3, characterized in that the yarn guiding eyelets which guide the two yarns are aligned in such a way that the yarn guiding eyelets guide the two yarns to different deflection rollers.

5. Yarn head rotor according to claim 1, characterized in that the cover of the housing can be used for positioning the bearings with the deflection rollers.

6. Yarn head rotor according to claim 3, characterized in that the housing is provided for the bearings of the end of the two deflection rollers.

7. Yarn head rotor according to claim 2, characterized in that precisely two deflection rollers having pivot axes are arranged in the yarn head rotor and that both pivot axes of the deflection rollers are arranged on a plane formed transverse or parallel to the rotor axis.

8. Yarn head rotor according to claim 1, characterized in that the bearings are glide bearings.

9. Yarn head rotor according to claim 1, characterized in that a portion of the gap extends in the radial direction with respect to the pivot axis, and the lid is configured so that grease flows within the gap to the bearing point when the bearings are in a resting position.

* * * * *